United States Patent [19]

Richard

[11] 4,004,942

[45] Jan. 25, 1977

[54] PROCESS AND APPARATUS FOR CLEANING PARTICULATE MATERIALS

[75] Inventor: Gerard Yves Richard, Precy sur Oise, France

[73] Assignee: Societe d'Applications de Procedes Industriels et Chimiques S.A.P.I.C., France

[22] Filed: June 5, 1975

[21] Appl. No.: 584,138

[30] Foreign Application Priority Data

June 10, 1974 France ..... 74.19976

[52] U.S. Cl. ..... 134/25 R; 15/305; 134/33; 134/37; 209/295; 241/5; 241/39; 241/DIG. 10

[51] Int. Cl.² ..... B08B 7/00

[58] Field of Search ..... 134/25 R, 33, 37; 15/305; 209/295; 241/5, 39, DIG. 10

[56] References Cited

UNITED STATES PATENTS

| | | | |
|---|---|---|---|
| 700,078 | 5/1902 | Pennypacker | 209/295 X |
| 2,143,497 | 1/1939 | Rahmberg | 209/295 X |
| 2,155,151 | 4/1939 | Schacht | 241/5 |
| 2,191,095 | 2/1940 | Hobbie | 241/39 |
| 2,707,314 | 5/1955 | Horth | 241/5 |
| 3,871,438 | 3/1975 | Vissers et al. | 241/DIG. 10 |
| 3,948,447 | 4/1976 | Jacob | 241/5 |

*Primary Examiner*—S. Leon Bashore
*Assistant Examiner*—Richard V. Fisher
*Attorney, Agent, or Firm*—Johnston, Keil, Thompson & Shurtleff

[57] ABSTRACT

A process and apparatus are provided for mechanically and pneumatically cleaning and stripping particulate granular and/or pulverulent solid materials which are particularly applicable to the regeneration of old foundry sand agglomerated by a binder. The particulate materials are introduced into and projected by a current of gas against the interior sides of a rotating drum where the materials are repeatedly subjected to a shock treatment.

5 Claims, 5 Drawing Figures

PROCESS AND APPARATUS FOR CLEANING PARTICULATE MATERIALS

The present invention relates to a process and to an apparatus for the mechanical and pneumatic cleaning, and the removing of dust from a granulous and/or pulverulent substance, the granules of which are covered with a gangue or with a covering membrane. It applies, especially, to the cleaning, for the purpose of its regeneration, of an old foundry sand agglomerated by means of mineral or organic binding agents, and especially by means of irreversible binding agents, such as the silicates and the organic resins (urea-formaldehyde, furanes, phenol-formaldehydes, for example).

It is well known that for the preparation of the molds and of the cores used in foundry work, granules are used, generally silica, or even granules of zircon or of olivine, coated with an agglomerating agent which, after self-hardening under cold or hot conditions, insures sufficient cohesion of the sand.

Because of the expense involved, and also because of the problems encountered by the evacuation of the used sands, foundry works have been led to search for all possibilities of recovering the used sands for the purpose of their re-use in connection with making new molds and cores by means of regenerated sand.

Among the various techniques of recovery and of regeneration of used foundry sands, there can be mentioned specifically regeneration by calcination, regeneration by chemical means, and regeneration by mechanical and pneumatic grinding and cleaning of the granules of sand. In all cases, the technique of regeneration eliminates all or a part of the pellicle or gangue of binding agent which coats the used granules.

The installations required for the regeneration, by mechanical and pneumatic cleaning of the sand, all include a device for the bringing in of a current of gas under pressure, each one of them oriented so that the gas current which is delivered will violently project the particles of sand against a hard surface which insures the mechanical wear stripping of the gangue. Such installations have been described, for example, in French Pat. Nos. 1,108,806 and 1,272,692.

French Pat. No. 2,115,097 also describes an installation for the regeneration of sand through the mechanical wear stripping of its gangue, said installation being essentially composed of a washing system composed of a vertical hermetrically sealed envelope inside which a gas current projects the sand granules horizontally toward the walls of the envelope, a set of baffles causing a reversed motion of the sand granules and regularly bringing them back from the walls toward the center of the envelope after each projection of air. By means of a system of projection in stages in the form of sheets of air, the washing system makes it possible to obtain a pneumatic cleaning of the sand, the efficiency of which has been proven in practice.

However, up to the present time, no apparatus for the purpose of mechanically eliminating the gangue by wear stripping has resulted in the complete disappearance of the binding material.

Now it has been found that a used sand recycled several times through the washing system lost, at each one of its passages, a certain quantity of organic material and of dust particles or 'fines' thus rendering better cleaning of the sand at each one of its passages.

The washing system, being a limited apparatus, because of its dimensions in height, limited to four or at most five levels, each one including a device for the projection of the particles against the wall, and a set of baffles which bring the particles back toward the center of the washing system, therefore has limits in that the used sand has a resistance time of the order of approximately ten seconds, corresponding to the time of treatment before being evacuated.

Of course, it is possible to multiply the washing systems by placing them one after the other, in cascade, but it is evident that such a solution presents a double drawback, i.e., increase in the cost of the installation, and an important increase of the volume of the material.

The purpose of the present invention is to remedy the aforementioned drawbacks, and to that end it has as its object a process and an installation for the mechanical and pneumatic cleaning which insure in a very reduced volume a continuous treatment of the grains of sand which insures their repeated wear stripping and a maximum cleaning over a period of time which, even though it is not limited, will in practice be of the order of 1 minute. The installation according to the present invention especially makes possible the projection with force of the grains of sand against a hard wall every two seconds, approximately, whereby there is a very great cleaning efficiency because the shock effects are appreciably increased which enable the organic pellicle of binding agent to be broken.

Moreover, an air current connected to a dust-removing source entrains the wastes and the fines as they are formed, thereby obtaining a definite and proper regeneration and cleaning of the sand.

According to the present invention, a process for the mechanical and pneumatic cleaning, and for the removing of dust therefrom of a granulous and/or pulverulent substance the granules of which are coated with a gangue or covering membrane, and especially for the cleaning and recovery of an old foundry sand agglomerated by means of binding agents, said process consisting of introducing the particles of the substance into a current of gas under pressure, suitable to project them violently against a hard surface, in order to cause the mechanical wear stripping of the gangue, is characterized by the fact that said granules are introduced into a rotating drum rotating around an axis which is approximately horizontal, in which the particles or grains are driven along as far as the high part of the drum from which they are released to fall by simple gravity following a trajectory which leads them into a current of gas under pressure, the direction of which is approximately horizontal, said current insuring the taking back of the particles and their projection with force against the lateral inner side of the rotating drum.

The present invention also has as its object the new industrial product produced by an apparatus for the invention, said apparatus including an envelope inside which there is delivered a current of gas under pressure, directed so that it projects the granulous substance against the interior wall of the envelope so that it will make possible the mechanical wear stripping of the gangue, and being characterized by the fact that it is composed of a drum, the rotation axis of which is approximately horizontal, and at least one tube connected to a source of gas under pressure, and extending approximately horizontally over the entire length of the drum, said tube presenting at least one thin longitudinal slit, placed over almost all of its length which makes possible the projection of the granules of the substance against the lateral interior side of a rotating drum, according to the principle of the sheet of air, said drum presenting on its lateral interior sides pockets which, at the time of rotation of the drum make it possible for the granules to be taken back to be transported from the lower part to the upper part of the drum, then they are discharged so that they are conducted by simple gravity in a position facing a current of fluid distributed from the slit whereby they are transported and projected again with force against the interior lateral side of said rotating drum.

Various forms of the invention will be described below, which are only illustrative and not limitative, with reference to the attached drawings.

THE DRAWINGS

Figure 3:
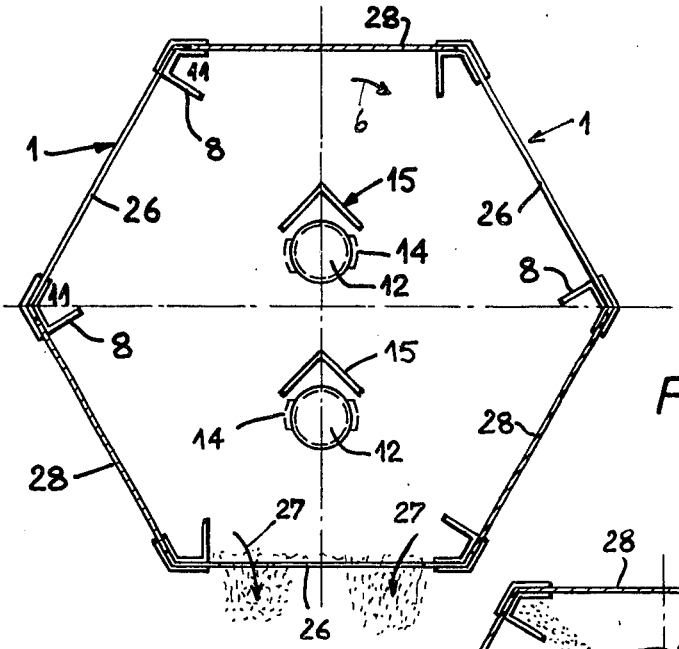
FIG. 3 represents a second variation of a form of the apparatus according to the present invention, a variation in which the drum which has a hexagon shaped cross section has three solid faces, three perforated faces alternately, and two tubes for the intake of the gas under pressure which extend into the drum in the vertical plane of symmetry of the latter.
Figure 4:
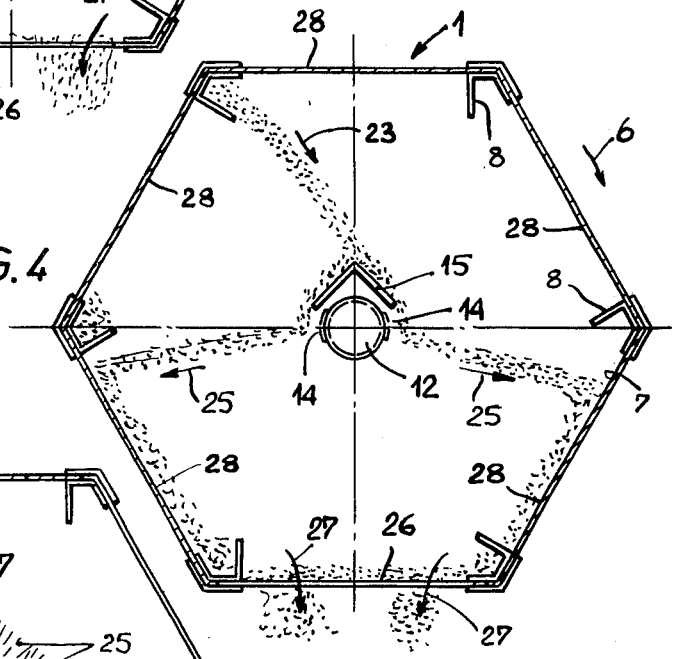
Figure 5:
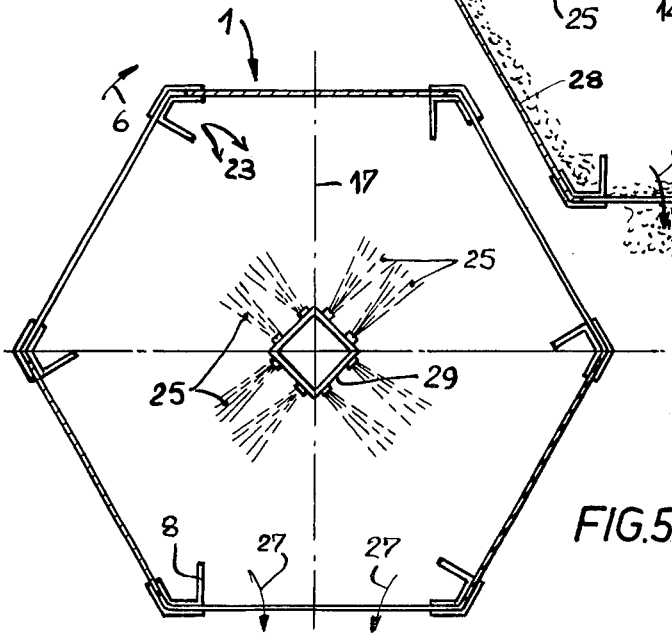

FIG. 4 represents an end view of a third variation of a form of the apparatus according to the present invention, a variation in which the drum with hexagon shaped cross section includes five solid faces and one perforated face; and FIG. 5 represents an end view of a variation of a form of the apparatus shown in FIG. 3, a variation in which the tube bringing the gas under pressure is a polygonal shaped core of which each face carries several air layers.

With reference to the drawings, it will be seen that there is designated at 1 a drum or trommel, the rotation axis 2 of which is approximately horizontal. The drum has a regular cross section, either a round one or a polygonal one, with four, six, eight or 10 sides. In the following description, there will be chosen as an example which is in no way limitative, a drum the cross section of which is a regular hexagon.

Figure 1:
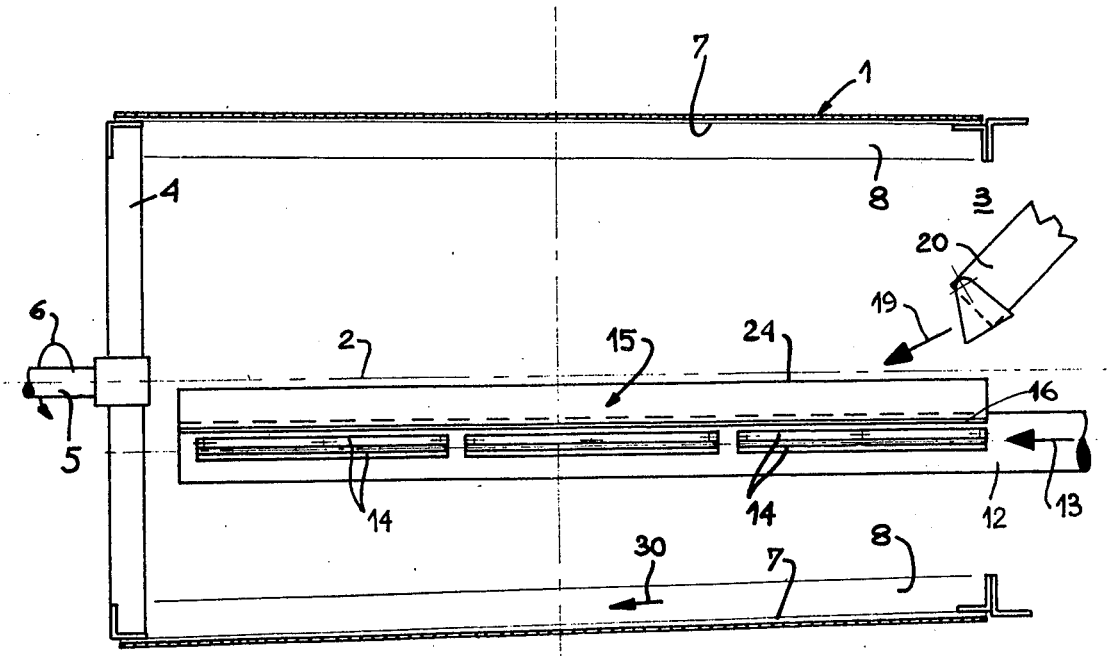
FIG. 1 represents a side view of the apparatus according to the present invention.

One of the two end sections of the drum is open, for example, section 3 represented to the right in FIG. 1, while the other end section of the drum is closed by means of a plate 4 which carries the motor shaft 5 centered on axis 2, and which controls the rotation of drum 1, diagrammatically shown by means of arrow 6.

The lateral interior side 7 of the drum carries baffles 8 placed evenly at the head of each face of the hexagon. These baffles are constructed in the form of a corner iron the wing 9 of which is perpendicular to the face of the drum which carries said corner or angle iron and is placed a few millimeters back from the edge 10 defined by two adjacent faces of the hexagon. Corner or angle iron 8 forms in such a way a pocket 11 the interior volume of which shall be used, as explained below, for the transportation of the granules of sand.

A tube 12, connected to a source of gas under pressure, diagrammatically shown by arrow 13, extends horizontally over the entire length of the drum from the open end section 3. Said tube is rigidly carried by a fixed organ, not shown, placed outside of drum 1. Tube 12, the cross section of which is either round or hexagon shaped, has on almost all of its length, thin longitudinal slits 14, either continuous or discontinuous, which work according to the principle of the sheet of air.

In one preferred mode in the practice of the invention, each tube 12 has an inverted V-shaped bonnet 15 above it, the brims of which extend as far as zone 16 located forward and above the thin slit or slits 14 for the intake of the gas under pressure with which the tube is fitted.

It is evident that for a more even and homogeneous treatment, the tubes 12, over which the bonnets 15 are located, can be located in the plane of vertical longitudinal symmetry 17 of the drum, when the latter has a regular cross section. The V-shaped bonnets which are reversed, also are fixed organs, and, for example, are carried by tabs 18 which are soldered at the upper part of the lateral wall of tube 12.

The functioning of the apparatus according to the present invention is as follows:

The used sand is introduced into the drum at point 19, for example, by means of a fixed hopper 20, which partially extends inside said drum from the open end section of the latter. The sand consequently rests in 21 on the lower side of the drum. When said drum is subjected to its rotation motion 6, a part of the sand lying in 21 is taken back and transported by the baffles 8, into their pockets 11, as schematically represented in 22. The speed of rotation of the drum being such that the centrifugal force to which the granules of sand are subjected is inferior to gravity, the granules are thus released at the high part of the drum, and they fall under the simple action of gravity, following a trajectory 23 which is slightly curvilinear and which takes them above bonnet 15 preferably on the high edge 24 of the latter. The granules of sand then go down along the wings of said bonnet, then they fall vertically, to be returned by currents 25 of gas under pressure, delivered from the air sheets 14. Said gas currents, under a medium or a strong pressure, violently project the sand against side 7 of the rotating drum which has the effect of causing a bursting or the beginning of a bursting of the gangue of binder which coats each granule. After their shock against side 7 of the drum, the granules have a tendency to fall back under the simple action of gravity, to rest at the bottom of the drum, a location from which they are returned by baffles 8 as previously explained.

The used granules of sand, at the time of their treatment, in this way follow the repeated path which includes a first motion from the bottom up, of transportation of the sand by means of baffles 8, followed by a motion in the opposite direction, which regularly brings the granules of sand to the bottom of the drum under the simple action of gravity. At the time of the second upward motion the grains of sand are each time projected with force against a hard surface causing wear stripping of their gangue by mechanical action.

In a drum 1,800 millimeters long, and 800 millimeters high which includes a tube fitted with two air sheets which deliver 5,000 cubic meters per hour of air under a pressure of 1,200 millimeters of water column, the drum rotating at a speed of 30 to 40 rotations per minute, the following results are obtained:

for a used sand containing 2.3% of organic materials at the start, there is obtained after 15 seconds the bursting and removal of 0.6% of organic material gangue; after 30 seconds of treatment, 1% removal is obtained; after 45 seconds of treatment 1.3% removal is obtained, and after 60 seconds of treatment 1.5% removal of the gangue is obtained.

It will therefore be seen that a washing system with four levels only permits a treatment of the order of 10 seconds, and only subjects the sand to four shock effects. The drum according to the present invention, rotating at approximately 40 rotations per minute, makes it possible to repeat the shock phenomenon seven times during 15 seconds of treatment, a situation which explains the appreciably improved cleaning insured by the apparatus according to the present invention. It is evident that the apparatus of the present invention can advantageously be combined with a dust-removing source which drives the fines along, on the one hand, and on the other hand drives the wastes from the organic particles of binder which are broken under the shock effect.

It will be seen that in a preferred method of the invention the cleaning drum rotates at a suitable speed with respect to its diameter, but preferably at a speed slow enough to prevent a centrifugal motion of the sand. In the aforementioned example, a speed of rotation of the order of 35 rotations per minute makes it possible for the sand to fall in 23 from the top of the drum, as far as edge 24 of the bonnet which protects the air sheets 14, the edge of the bonnet being placed, in this particular example, along the longitudinal axis of symmetry of the drum. It is evident that the position of tubes 12, and therefore the position of the projecting bonnets determine the speed of rotation 6 of the drum. For greater accuracy in handling, the rotation controlling device for the drum, is thus mounted on a speed varying device in order to determine with the greatest possible precision the optimum speed of rotation of the drum which insures the preferential falling of the sand.

According to one variation of the invention drum walls with anti-wear plates of sheet metal, fitted with judiciously calibrated perforations, can be employed. There are thus provided sieves or sieving zones which, when the opening of the meshes is such that they allow the passage of the grains freed from their gangue, insure the separation, regularly and progressively, of the insufficiently treated grains from the regenerated grains, suitable for a new use. While the insufficiently treated granules are held back by the meshes of the sieve, and undergo one or several additional cycles of treatment, the granules which have been freed from their gangue flow into the sieving zones 26, through the meshes in 27, and are taken, pneumatically, for example, as far as a storage tank.

In that mode of execution, it has been observed that the efficiency of the drum is naturally increased since the sand can be held longer in the apparatus by means of the regulation of its rate of evacuation through the meshes of the perforated sides. It is evident, therefore, that the repeated number of recyclings makes possible a cleaning efficiency which is proportional to the number of times the granules of sand pass in front of the air sheets, with the effect of violent projection against the sides. In addition, the construction of some of the sides of the drum of anti-wear sheet metal which is perforated, permits continuous working with a grinding and sieving action of the small lumps depending on the number and diameter of the perforations. At the same time, the determination of the opening of the holes may insure, if need be, a slow passage of the granules of sand, and consequently, numerous recyclings which insure their maximum cleaning.

Figure 2:
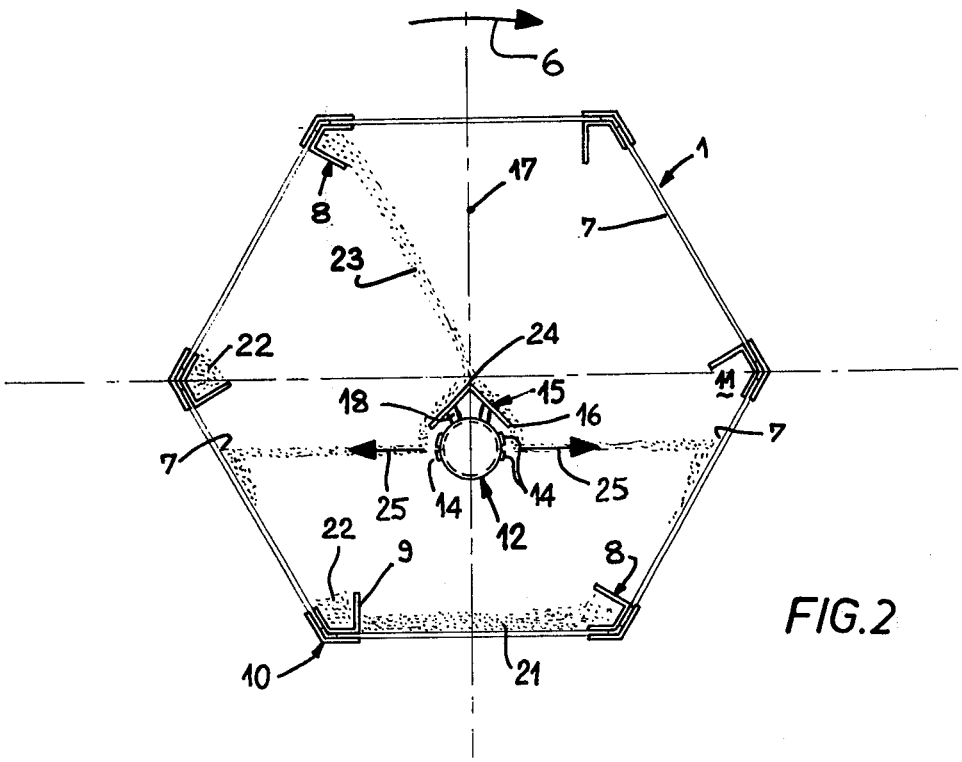
FIG. 2 is an end view of a first variation of a form of the apparatus according to the present invention, a variation in which the drum has a hexagonal cross section, each face of the hexagon being constructed in the form of a sieve.

On a drum with a hexagonal cross section, there is a possible limit of conceivably six perforated sides (FIG. 2), or three perforated sides 26 and three solid sides 28 alternately located (FIGS. 3 and 5), or even five solid sides 28 and one perforated side 26 (FIG. 4), this latter arrangement appearing to lead to optimum wear stripping of the gangue.

The efficiency of the cleaning drum may be increased by placing inside it, in replacement for a single tube 12 with air sheet 14, a battery of tubes with air sheets (FIG. 3), or even a small box, either square, hexagonal or octagonal, as the drum itself (FIG. 5), each tube of the battery or each face of the box including several air sheets, in order to multiply to a maximum the possibilities of projection of the sand against the sides. In all cases, whenever the drum has a regular section, the battery of tubes or the small boxes, either protected or not by means of a bonnet, will advantageously be placed in the vertical plane of symmetry of the drums.

It is evident that the present invention is not limited to the modes of application, nor to the modes of execution which have been indicated. Many variations can be made without departing from the scope of the invention, and it would be especially advantageous to provide for a drum having the shape of a truncated cone or that of a truncated pyramid, with a horizontal axis, the latter conception presenting the advantage of preventing the sand from escaping during the period of treatment. The latter variation can be employed when the drum presents a solid plate 4 on one side and an opening 3 on the other. The sand which is introduced through hopper 20 would present a tendency to escape through opening 3, and as a result, a drum in the shape of a truncated cone or of a truncated pyramid, the larger base of which is constituted by the motor plate, will have a tendency to bring the granules of sand regularly back toward said plate 4, as diagrammatically represented by arrow 30, during all of the aforementioned operations of treatment.

I claim:

1. A process for mechanically and pneumatically cleaning and stripping a particulate substance comprising introducing particles of said substance into a current of gas under pressure, projecting said particles by means of said current of gas against the interior sides of a rotating drum from a fixed point adjacent the central axis of said drum, carrying the resultant particles upwardly in the direction of rotation of said drum, and allowing them to fall by gravity into said current of gas whereby they are intermittently and repeatedly subjected to shock treatment against the interior sides of said drum.

2. A process as claimed in claim 1 in which said particulate substance is a foundry sand containing a resin binder.

3. Apparatus for mechanically and pneumatically cleaning particulate substances comprising a drum which rotates around an approximately horizontal axis, a fixed tube disposed in said drum longitudinally, said tube containing small openings therein at intervals along said tube and being connected to means for supplying gas under pressure, whereby gas under pressure can be introduced through said tube so as to pass through said openings and be directed toward the interior sides of said drum, said drum containing at intervals on the interior sides thereof pockets which are open to receive said particulate substances to be cleaned and which when rotated with said drum from the lower part of the drum to the upper part of the drum discharge said substances to be cleaned by gravity into the current of gas issuing from the openings in said tube, means for introducing the particulate substances to be cleaned into the current of gas issuing from the openings in said tube, and means for rotating said drum so that said particulate substances are projected in said current of gas against the interior sides of said drum while the latter is rotating, whereby they are intermittently and repeatedly submitted to shock treatment against the interior sides of said drum.

4. Apparatus for mechanically and pneumatically cleaning particulate substances comprising a drum which rotates around an approximately horizontal axis, a fixed tube disposed in said drum longitudinally, said tube containing small openings therein at intervals along said tube and being connected to means for supplying gas under pressure, said openings being in the form of slits which produce a sheet-like current of said gas whereby gas under pressure can be introduced through said tube so as to pass through said openings and be directed toward the interior sides of said drum, means for introducing the particulate substances to be cleaned into the current of gas issuing from the openings in said tube, and means for rotating said drum so that said particulate substances are projected in said current of gas against the interior sides of said drum while the latter is rotating, whereby they are intermittently and repeatedly submitted to shock treatment against the interior sides of said drum.

5. Apparatus for mechanically and pneumatically cleaning particulate substances comprising a drum which rotates around an approximately horizontal axis, a fixed tube disposed in said drum longitudinally, said tube containing small openings therein at intervals along said tube and being connected to means for supplying gas under pressure, whereby gas under pressure can be introduced through said tube so as to pass through said openings and be directed toward the interior sides of said drum, means for introducing the particulate substances to be cleaned into the current of gas issuing from the openings in said tube, said tube having an inverted V-shaped bonnet in combination therewith whose sides extend on either side of said tube with the lower parts of said sides over the paths of discharge of the current of gas from said tube, and means for rotating said drum so that said particulate substances are projected in said current of gas against the interior sides of said drum while the latter is rotating, whereby they are intermittently and repeatedly submitted to shock treatment against the interior sides of said drum.

* * * * *